US006908372B2

(12) United States Patent
Larsson

(10) Patent No.: US 6,908,372 B2
(45) Date of Patent: Jun. 21, 2005

(54) HOLE CUTTING TOOL AND METHOD

(75) Inventor: Lars G. Larsson, Saro (SE)

(73) Assignee: Cold Cut Systems Svenska AB, Kungsbacka (SE)

( * ) Notice: Subject to any disclaimer, the term of this patent is extended or adjusted under 35 U.S.C. 154(b) by 0 days.

(21) Appl. No.: 10/311,431

(22) PCT Filed: Jun. 14, 2001

(86) PCT No.: PCT/SE01/01341

§ 371 (c)(1),
(2), (4) Date: Jan. 27, 2003

(87) PCT Pub. No.: WO01/98031

PCT Pub. Date: Dec. 27, 2001

(65) Prior Publication Data

US 2003/0190871 A1 Oct. 9, 2003

(30) Foreign Application Priority Data

Jun. 19, 2000 (SE) ..... 0002295

(51) Int. Cl.[7] ..... B24C 3/06

(52) U.S. Cl. ..... 451/75; 451/38; 451/88; 83/177; 51/410

(58) Field of Search ..... 451/38, 75, 88, 451/90, 87, 102, 101; 239/430, 433, 429, 310, 318, 591, 600; 83/177; 51/410, 425

(56) References Cited

U.S. PATENT DOCUMENTS

| | | | | |
|---|---|---|---|---|
| 1,998,729 A | | 4/1935 | Mathey et al. | |
| 4,272,017 A | * | 6/1981 | Franz | 239/1 |
| 4,878,320 A | * | 11/1989 | Woodson | 451/39 |
| 5,001,870 A | * | 3/1991 | Yokota et al. | 451/92 |
| 5,010,694 A | | 4/1991 | Agbede | |
| 5,626,508 A | * | 5/1997 | Rankin et al. | 451/102 |
| 5,643,058 A | * | 7/1997 | Erichsen et al. | 451/99 |
| 5,908,349 A | * | 6/1999 | Warehime | 451/102 |
| 6,086,459 A | * | 7/2000 | Naegelin | 451/54 |
| 6,216,573 B1 | * | 4/2001 | Moutafis et al. | 83/177 |
| 6,276,993 B1 | * | 8/2001 | Miller | 451/40 |
| 6,379,214 B1 | * | 4/2002 | Stewart et al. | 451/2 |
| 6,464,567 B2 | * | 10/2002 | Hashish et al. | 451/38 |
| 6,470,978 B2 | * | 10/2002 | Trueman et al. | 175/67 |

FOREIGN PATENT DOCUMENTS

| | | |
|---|---|---|
| DE | 29 16 131 | 11/1979 |
| DE | 42 02 516 | 8/1993 |
| DE | 197 11 512 | 10/1998 |
| EP | 0 537 869 | 4/1993 |
| EP | 0 653 271 | 5/1995 |
| EP | 0 710 511 | 5/1996 |
| WO | WO 84/02673 | 7/1984 |
| WO | WO 95/00388 | 1/1995 |

* cited by examiner

*Primary Examiner*—Joseph J. Hail, III
*Assistant Examiner*—Anthony Ojini
(74) *Attorney, Agent, or Firm*—Burns, Doane, Swecker & Mathis, LLP

(57) ABSTRACT

A tool and a method for cutting holes in a container wall such as in a tank, a cistern, a pipeline, a vehicle, a ship, a production like or the like that contains inflammable, explosive, or other hazardous gasses, and liquids. The tool includes means for pressurising a cutting medium and discharging said medium via a nozzle. The nozzle is arranged in an enclosing cover including a scalable safety outlet for evacuation of the container contents. The cover has means of sealed-off abutment against the container wall concerned in the area in which hole cutting is to be performed. The nozzle is arranged to be directed towards the container wall in such a way that in use the cutting medium is discharged in the form of a jet impinging against the container wall with sufficient force to cut through said wall.

14 Claims, 3 Drawing Sheets

HOLE CUTTING TOOL AND METHOD

TECHNICAL FIELD OF INVENTION

The present invention relates to a tool for cutting holes in container walls, such as in tanks, cisterns, reservoirs, pipelines, vehicles, boats, production lines or the like that contain inflammable, explosive or other hazardous gases and liquids.

BACKGROUND OF THE INVENTION

In connection with accidents involving for example tank cars, gas tanks, cisterns, pipelines, production lines and the like it is often necessary to evacuate their contents before normal safety measures can be initiated. The work involved in the evacuation of inflammable, explosive or other hazardous and perilous gases and liquids constitutes a considerable hazards both to persons actively taking part in the rescue work and to persons present in the immediate surroundings.

Rescue methods according to prior-art technology therefore often involve vacating people from the immediate surroundings, which could be quite an extensive operation in case the accident occurs for example in a densely populated area.

According to prior-art methods of evacuating gases and liquids from containers the valves of which have become unserviceable or for some other reason cannot be used, a sleeve is welded onto the container wall so as to be tightly secured thereto. A valve is then mounted on the sleeve and an aperture is drilled through the valve and the container wall with the aid of a special drill. The reason for attaching the sleeve by means of welding is to ensure that it can withstand the forces exerted in the drilling operation. The sleeve, the valve, and the cover surrounding the drill usually are filled with nitrogen in order to reduce the risk of ignition by the heat generated in the drilling operation. Hoses are connected to the valve, causing the contents to flow automatically or by suction into a fresh container, alternatively to a flare for flaring. Today, the welding step as well as the subsequent drilling step are at least partly effected manually, which often constitutes a danger to the lives of the persons involved, particularly if the containers hold explosive, poisonous or inflammable materials and both steps are carried out under heat-release conditions.

Naturally, it is a serious problem that several steps of the evacuation work according to prior-art technology need to be carried out in a manner endangering the lives of the workmen and therefore also constituting a considerable risk of exposing the surrounding area to hazards. Consequently, there is a considerable need for a method allowing containers holding dangerous material to be emptied in a less risky way, particularly in conjunction with clearance work occasioned by accidents or the like. Since dangerous goods is transported also through densely populated areas, there is likewise a need for avoiding, as far as possible, situations that may lead to a large number of individuals having to be vacated from the immediately surrounding area. This type of operations delay the rescue work proper and are both expensive and complex.

SUMMARY OF THE INVENTION

The main object of the present invention therefore is to provide a solution of evacuating gases or liquids, particularly dangerous or explosives gases or liquids, that is safer than prior-art solutions. This purpose is achieved in accordance with the invention by means of a method and a tool for cutting holes in constructions of the kind outlined in the introduction.

With respect to the method, this main object is achieved by cutting by means of a pressurised cutting medium, which is sprayed during the cutting operation into the construction concerned in the form of a cold-cutting jet issued from a nozzle encased in a cover placed in sealed-off abutment against the container wall, from which, container the contents therein are discharged via a safety outlet. The method makes possible to effect the sealed-off application as well as the hole cutting steps while using methods that do not involve any risk of generation of sparks and other uncontrollable development of heat.

The hole-cutting tool possesses the characterising features appearing from the appended claim 1. Preferred embodiments of the hole-cutting tool are defined in the dependent claims.

Thus, the invention also concerns a tool for cutting holes in a wall of a container, such as e.g. a wall of a tank, a cistern, a reservoir, a pipeline, a vehicle, a ship, a production line or the like, containing inflammable, explosive or other perilous gases and liquids, said tool comprising means for pressurising a cutting medium and discharging said medium via a nozzle, at least the nozzle being arranged in an enclosing cover comprising a safety outlet for evacuation of the container contents, and having means for sealed-off abutment against the container wall concerned in the area in which the hole cutting is to be performed, said nozzle arranged to be directed towards the container wall in such a way that in use the cutting medium is discharged in the form of a jet impinging against the container wall with sufficient force to cut through said wall.

Because a cover is arranged around the hole-cutting equipment in sealed-off abutment against the container wall, an encapsulated space is created in which the hole-cutting operation may be performed under safe and controllable conditions. The parts abutting against the container wall are provided with seals. The seals are made from a porous or a resilient material, such as rubber. The tool is attached to the container wall using such means as strapping, chains, wires or glue. Another method is to use vacuum.

Another advantage of the invention is that it allows test pressurisation prior to cutting the hole and the subsequent evacuation, in order to check whether these operations may be carried out in a safe way and consequently the risks be minimised. Depending on the test-pressurisation results and other circumstances connected with the accident, the sealing arrangements may have to be improved further prior to the hole being cut. The improvement may involve for instance making the very means for tighter abutment more powerful or applying silicone between the seals.

In accordance with the teachings of the invention, the hole-cutting tool is formed with an arm, which carries the nozzle for rotary motion about a shaft. Owing to the rotating nozzle circular holes are formed, resulting in the most even distribution of tension possible in the container wall in the area surrounding the hole.

In one embodiment of the invention, the nozzle-carrying arm is formed with an internal channel for supply of the cutting medium, said arm being designed with essentially right-angled bends. The reason therefor is that the pressurised medium contains or is admixed with an abrasive to increase the cutting ability of the jet. In addition, the abrasive considerably increases the friction on the nozzle and on other part of the system. In order to reduce the wear on the channel walls, the bonds in accordance with one embodiment are given an essentially right-angled configuration. Some of the abrasive will then settle as a protective bed between the channel wall and the pressurised cutting medium and in this manner reduce the abrasive effects on the internal face of the channel wall.

To achieve a cutting effect on the above-enumerated objects that are relevant for the intended purpose, the cutting medium should have a pressure of 100–600 bars when leaving the nozzle. The flow rate of the cutting medium should be about 10–50 l/min through the nozzle.

An additional advantage gained by the invention is that the most hazardous steps found in the prior-art technology either are eliminated or may be carried out by personnel working at a safe distance from the critical area. Once the tool is applied in abutment against a container wall, it may be remote-controlled from a control centre located at a suitable distance from the hole-cutting area. The jet pressure and the rate of flow through the nozzle, for example, may be controlled from the operating centre according to one embodiment. Also the rotary motion of the nozzle above the container wall as also the supply of a correct amount of abrasive are remote-controlled. In this manner no human being in the vicinity need be exposed to danger during the very hole-cutting operation.

The individual situation and other circumstances prevailing while a container of some kind need to be emptied obviously will govern the actual method, and the invention offers further possibilities to be implemented according to need. Since evacuation will often be necessary whenever pressurised, highly inflammable or combustible substances are involved, a particularly advantageous features of the tool is for instance that it may comprise means to allow test pressurisation prior to initiation of the operation itself. This test pressurisation may also be controlled and the results be read from a control station situated outside he hazard area.

As regards the case described above, the safety outlet from the cover preferably is provided with a closure device, such as a valve of some kind that could be subjected to checking. Also this closure device preferably is adjustable by means of remote control of some kind.

Should a container holding a poisonous medium need to be evacuated, without any risks of leakage, and the medium need to be transported through some distance it is possible to employ for instance a hole-cutting tool not equipped with a controllable closure device in the area of the safety outlet since in such a case pressure control is of lesser importance.

The cutting medium and the abrasive are chosen in consideration of the contents of the container and their tendency of reaction to various substances. Commonly used abrasives that may be employed in conjunction with the present invention are for example iron oxide, aluminium oxide, silica sand, garnet minerals and similar minerals. As regards hazardous goods, official rules and regulations specify which substances may be combined.

Within the scope of the inventive idea, the various characterising features of a tool or a method of the kind defined above could of course be combined freely or exist as independent embodiments.

BRIEF DESCRIPTION OF THE DRAWINGS

The invention will be further described in the following by way of one embodiment and with reference to the accompanying drawings, wherein.

DETAILED DESCRIPTION OF A PREFERRED EMBODIMENT

Figure 1:
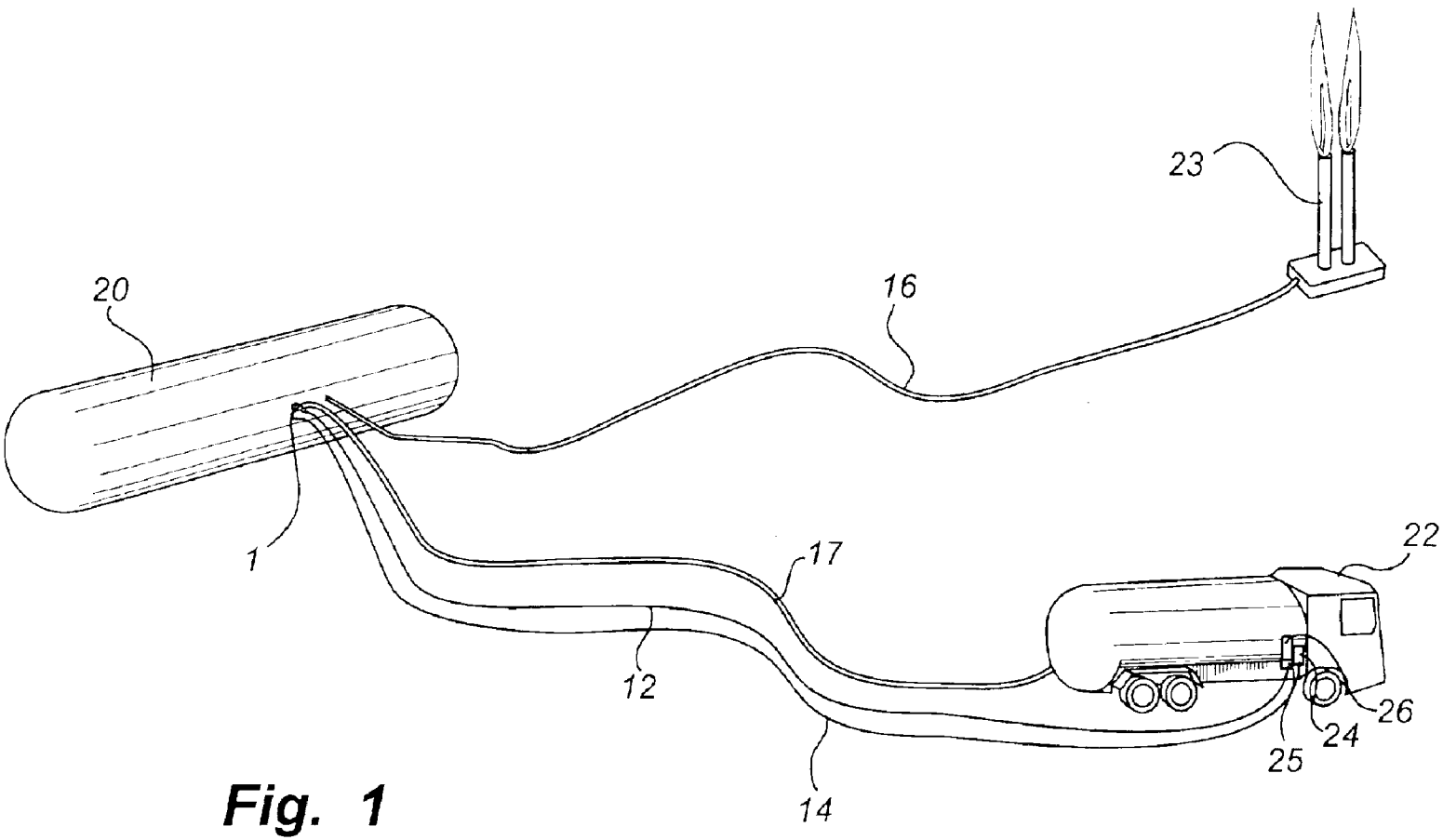
FIG. 1 is a schematic view of an arrangement of means for cutting holes in a tank with a view to evacuate its contents.

FIG. 1 illustrates schematically an arrangement of means for evacuation of the contents of a tank 20. A tank car 22, comprising a control centre 25 for controlling a hole-cutting tool 1, is positioned at a point spaced from the tank 20 concerned. The control of the hole-cutting tool 1 may be effected by transfer of signals between the control centre 25 and the hole-cutting device 1 wireless-fashion or via a cable 14.

In accordance with the preferred embodiment shown and described herein, the pressure source preferably is a motor-driven high-pressure pump 24. The motor could be a hydraulic motor, which in turn is powered by a pump or an engine, not shown, such as a combustion engine. The motor as well as the high-pressure pump 24 are of more or less conventional design and are installed in the tank car 22 shown in the drawing figure. The capacity of the high-pressure pump 24 is such as to enable it to discharge the pressurised medium at a pressure in the range of 100–300 bars, preferably about 200 bars and a flow rate in the range of 10–50 l/min, preferably about 40 l/min. In some applications the pressure of the cutting medium as it leaves the nozzle could, however, be as high as up to 600 bars, which shows that other embodiments are not restricted to only the pressure interval of 100–300 bars. Also the flow rate could exceed the value defined above, depending on the area of application, and could amount to more than 100 l/min.

Normally, the cutting medium 19 is ordinary water, to which preferably is added one or several liquid and/or particulate additives to increase the hole-cutting ability. One additive of this kind is an abrasive, such as a blasting agent containing particles of iron, sand, or some other abrasive substance that increases the speed of cutting through the container wall. For cutting holes in a container wall made from stainless steel aluminium oxide is advantageously used as the abrasive. Depending on the contents of the container to be evacuated, water sometimes is an unsuitable cutting medium 19 and in such cases it may be replaced by for instance oil.

The equipment described above also comprises a vessel 26 containing the described abrasive that is added to the cutting medium. Furthermore, FIG. 1 shows a flaring device 23, in which residual gases may be combusted after having been fed through a draw-off hose 16 from the tank 20 that is being evacuated. In many cases, parts of the contents may be utilised and the inventive idea also covers the possibility of conveying the container contents through another draw-off hose 17 to another container, as illustrated in FIG. 1 by the tank of tank car 22.

Figure 2:
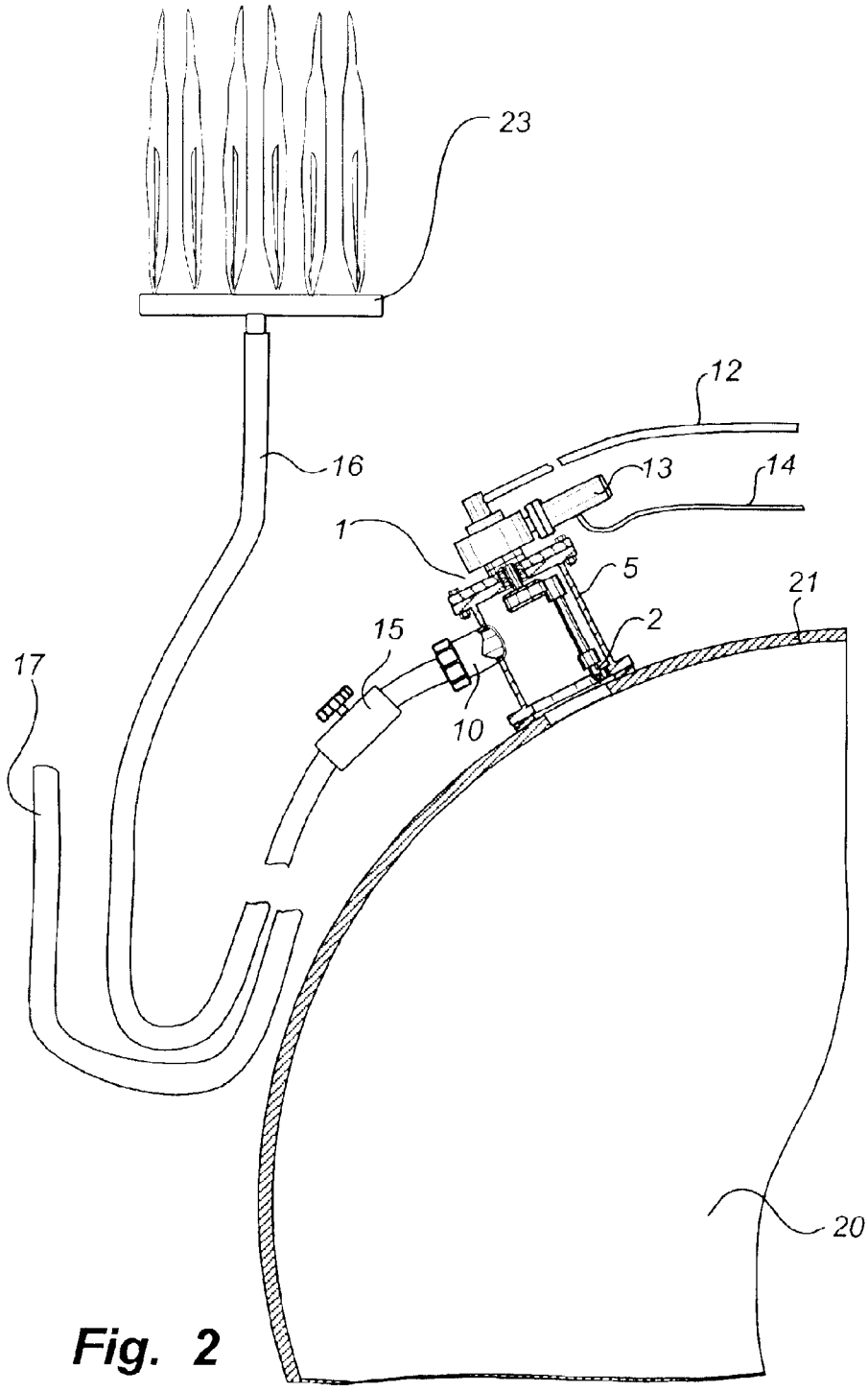
FIG. 2 is a principle sketch showing the manner in which the hole-cutting tool is applied against a container wall.

FIG. 2 shows the tank 20 together with the hole-cutting tool 1 in its position mounted on the container wall 21. Summarily, it could be described as a device to be placed around the cutting-tool proper and comprising a cover 5 having a safety outlet 10 and sealing means 7, designed for sealed-off abutment, located at the cover end intended to be applied against the container wall 21. In order to allow completely sealed-off abutment between the cover 5 and the container wall 21 the sealing means 7 ensuring sealed-off abutment may have a slightly curved configuration at the base of the cover 5, corresponding to the curvature described by the radius of the container 20 concerned.

In a preferred embodiment, the sealing means 7 is made from some rubber material. The sealing means could for instance be in the form of two rubber mouldings extending next to one another in spaced-apart relationship around the lower face of the cover 5. The groove formed intermediate the rubber mouldings then forms a cavity from which, when the cover 5 abuts against the container wall 21, the air may be evacuated, for instance by means of a vacuum bell jar, not shown herein. The hole-cutting tool 1 may be fixed securely to the container wall 21 by other methods than by vacuum. Other alternatives are by means of strapping, chains or wires, should the circumstances otherwise allow attachment of the hole-cutting tool 1 by such means. Other alternatives to vacuum are glue, magnets or, as a matter of fact welding, should this be considered reasonable in view of the situation otherwise. These various alternatives could of course be combined in various ways to provide optimally sealed-off abutment conditions. The advantage of this method and tool is that it allows test pressurisation to be effected before the very hole-cutting operation is initiated. Should a risk of leakage still persist, silicon is applied between the seals.

From the safety outlet 10 extend one or several hoses, their number depending on how one chooses to distribute the contents being evacuated. According to one preferred embodiment of the invention an adjustable closure device 15 is installed adjacent the safety outlet 10. The closure device 15 is adjustable between a completely closed position, not shown, wherein the device is closed tightly, also when exposed to considerable excess pressures of 10–20 bars or more, and an open position, wherein the contents in the form of liquid or gas is allowed to flow out of the container.

Figure 3:
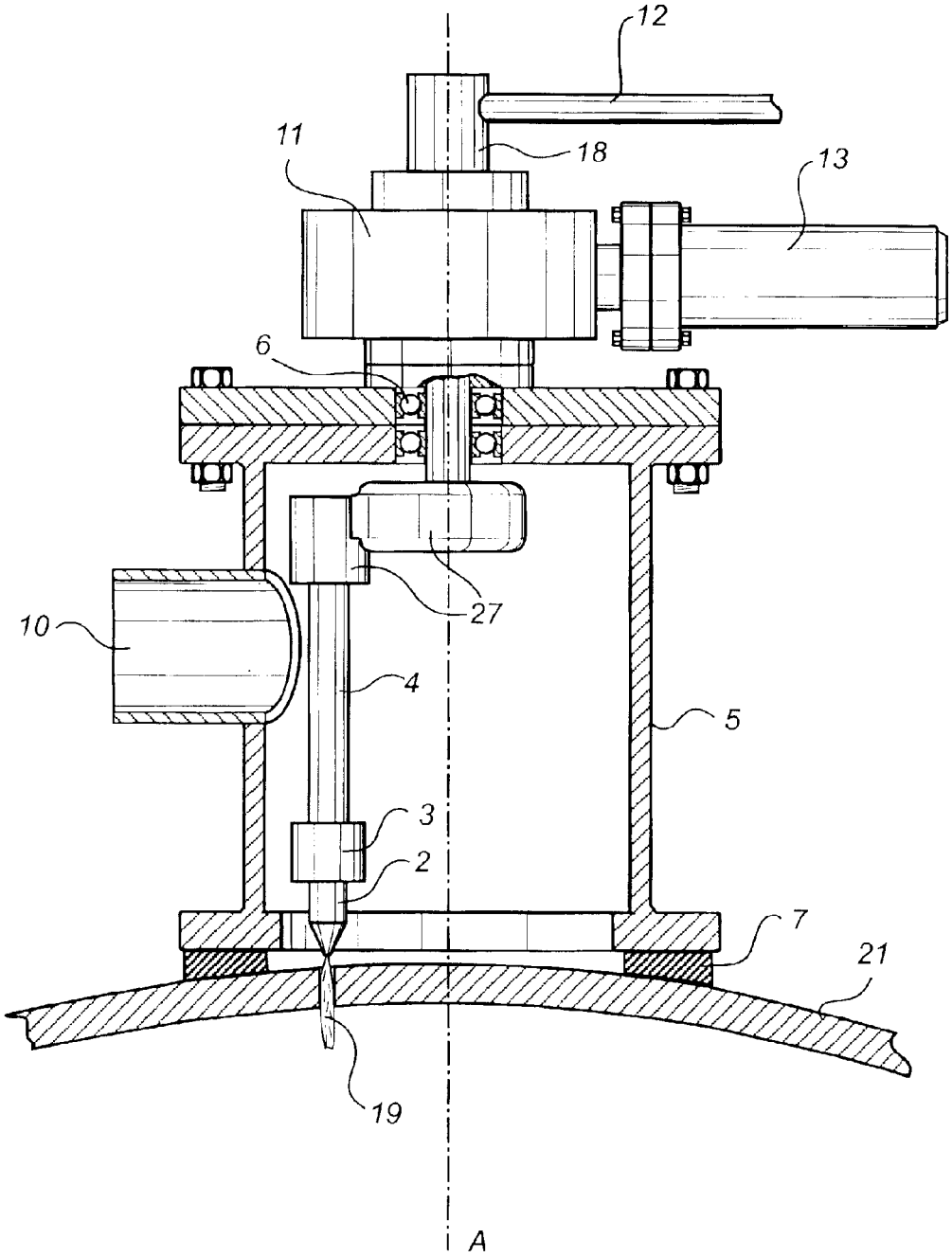
FIG. 3 is an enlarged view of part of FIG. 2.

In FIG. 3, the line 12 through which the cutting medium 19 is supplied, is coupled to the nozzle 2 via a rotary arm 4, which is formed with bends 27. The arm 4 is formed with an internal channel, through which the cutting medium 19 is supplied. The bends 27 are essentially right-angled in order to force some of the abrasive of the cutting medium to collect in the corners of the bends, where they remain in the form of a protective bed between the continuously supplied cutting medium 19 and the channel. Contrary to expectations, this configuration of the arm 4 imparts an increased serviceable life.

From the nozzle 2, the cutting medium 19 in the form of a jet is made to impinge on the container wall 21 to sever the latter for the hole-cutting operation. Because the nozzle 2, which is supported by the arm 4 by means of a nozzle holder 3, is made to perform a rotary movement about an axis (A) while at the same time the jet is being discharged through the nozzle, a hole of essentially circular configuration is eventually made in the container wall.

The cover 5, when assuming its mounted position, together with the container wall 21 form a closed capsule around the nozzle 2. In order to feed cutting medium 19 to the rotating arm 4 from the pipeline 12, the cutting medium 19 is passed through some kind of swivel means 18 and a gasket 6. The purpose of the gasket 6 is to ensure that the supply to the encapsulated nozzle 2 is effected without leakage. The arm 4 is made to rotate about an axis (A) by a rotator, not shown, which via a hydraulic-motor connector 13, 14 is connected to a pressure source 24, such as a hydraulic motor.

As will be appreciated, the invention should not be considered restricted to the embodiment as shown and described but may be varied at liberty within the scope of protection as defined in the appended claims.

What is claimed is:

1. A tool for cutting holes in a container wall such as in a tank, a cistern, a pipeline, a vehicle, a ship, a production line or the like that contains inflammable, explosive, or other hazardous gases and liquids wherein the tool comprises means for pressurising a cutting medium and discharging said medium via a nozzle, in that at least the nozzle is arranged in an enclosing cover comprising a safety outlet for evacuation of the container contents, and having means for sealed-off abutment against the container wall concerned in the area in which hole cutting is to be performed, said nozzle arranged to be directed towards the container wall in such a way that in use the cutting medium is discharged in the form of a jet impinging against the container wall with sufficient force to cut through said wall.

2. A tool as claimed in claim 1, said tool formed with an arm supporting the nozzle for rotational movement about an axis.

3. A tool as claimed in claim 2, wherein said arm supporting the nozzle has an internal channel for supply of the cutting medium, said arm being formed with essentially right-angled bends.

4. A tool as claimed in claim 2, said tool comprising an adjustable closure means arranged adjacent the safety outlet.

5. A tool as claimed in claim 2, said tool arranged in such a manner as to ensure that the pressurised cutting medium has a pressure of 100–600 bars upon leaving the nozzle.

6. A tool as claimed in claim 2, said tool arranged in such a manner as to ensure that the cutting medium flow rate through the nozzle is in the range of 20–60 l/mm.

7. A tool as claimed in claim 2, wherein at least the arm and the nozzle are remote-controlled from a control station located at a distance from the hole-cutting area.

8. A tool as claimed in claim 1, wherein the pressurised cutting medium contains or is admixed with an abrasive.

9. A tool as claimed in claim 1, said tool comprising an adjustable closure means arranged adjacent the safety outlet.

10. A tool as claimed in claim 1, said tool arranged in such a manner as to ensure that the pressurised cutting medium has a pressure of 100–600 bars upon leaving the nozzle.

11. A tool as claimed in claim 1, said tool arranged in such a manner as to ensure that the cutting medium flow rate through the nozzle is in the range of 20–60 l/mm.

12. A tool as claimed in claim 1, wherein at least the arm and the nozzle are remote-controlled from a control station located at a distance from the hole-cutting area.

13. The tool of claim 1, wherein the sealed-off abutment against the container is static.

14. A tool for cutting holes in a container wall such as in a tank, a cistern, a pipeline, a vehicle, a ship, a production line or the like that contains inflammable, explosive, or other hazardous gases and liquids wherein the tool comprises means for pressurising a cutting medium and discharging said medium via a nozzle, in that at least the nozzle is arranged in an enclosing cover comprising a safety outlet for evacuation of the container contents, and having means for sealed-off abutment against the container wall concerned in the area in which hole cutting is to be performed, said nozzle arranged to be directed towards the container wall in such a way that in use the cutting medium is discharged in the form of a jet impinging against the container wall with sufficient force to cut through said wall, said tool formed with an arm supporting the nozzle for rotational movement about an axis, wherein said arm supporting the nozzle has an internal channel for supply of the cutting medium, said arm being formed with essentially right-angled bends.

* * * * *